United States Patent [19]

Zhupakhin et al.

[11] 4,002,816

[45] Jan. 11, 1977

[54] DEVICE FOR MEASURING MASS OF CONSUMABLE ELECTRODES BEING REMELTED IN ELECTRIC FURNACES

[76] Inventors: Anatoly Dmitrievich Zhupakhin, ulitsa Teatralnaya, 4, kv. 45; Gennady Ivanovich Prokoshev, Shosse Metallurgov, 53a, kv. 206, both of Chelyabinsk; Boris Konstantinovich Karavashkin, ulitsa Nevezhina, 15, kv. 25, Kurgan; Felix Iosifovich Shved, ulitsa B. Khmelnitskogo, 18, kv. 21, Chelyabinsk; Rashat Faskheevich Maksutov, prospekt Lenina, 77, kv. 38, Chelyabinsk; Evgeny Fedorovich Gavrilin, Shoose Metallurgov, 53a, kv. 217, Chelyabinsk; Vasily Andreevich Mushenkov, Trudovaya ulitsa, 17a, kv. 35, Chelyabinsk; Anatoly Borisovich Sergeev, Teatralnaya ulitsa, 4a, kv. 26, Chelyabinsk; Alexandr Fedorovich Shkapa, Elektrostalskaya ulitsa, 47, kv. 71, Chelyabinsk; Lev Alexandrovich Zhivichkin, ulitsa 3 Sputnika, 3a, kv. 56, Chelyabinsk, all of U.S.S.R.

[22] Filed: Aug. 4, 1975

[21] Appl. No.: 601,703

[52] U.S. Cl. ..... 13/12

[51] Int. Cl.[2] ..... H05B 7/148; F27D 11/10

[58] Field of Search ..... 13/1, 9, 12, 13, 18, 13/14–17

[56] References Cited

UNITED STATES PATENTS

| | | | |
|---|---|---|---|
| 3,614,284 | 10/1971 | Scheidig | 13/13 |
| 3,622,678 | 11/1971 | Allen | 13/13 |
| 3,868,473 | 2/1975 | Dimick | 13/12 X |

*Primary Examiner*—R. N. Envall, Jr.

[57] ABSTRACT

The device of the invention comprises a hollow cooled rod on which a mass transmitter for a consumable electrode is secured. The casing of the mass transmitter accommodates two bellows of different diameter operating as a sensitive element interacting with an annular projection on a bar shifting along the axis of the bellows and acting as a movable element. The bellows are arranged one above the other along the bar axis, one end of each of the bellows being fixed on the annular projection and the other, on the casing. One bar end face is rigidly associated with the consumable electrode holder and the other one has a recess filled with a current-conducting liquid medium receiving the rod end face directed towards the bar. The bellows space defined by the bellows proper, the casing and annular projection is filled with a liquid, variations in the pressure thereof being indicative of the mass of the consumable electrode.

16 Claims, 6 Drawing Figures

DEVICE FOR MEASURING MASS OF CONSUMABLE ELECTRODES BEING REMELTED IN ELECTRIC FURNACES

FIELD OF THE INVENTION

The present invention relates to electrometallurgy and more particularly to a device for measuring the mass of electrodes being remelted in electric furnaces.

BACKGROUND

The problem of continuous measurement of the mass of consumable electrodes in electric furnaces, especially vacuum-arc ones, is still far from being solved. Determining the electrode mass in the course of remelting is necessary to ascertain the exact instant the forming shrink hole regulation must be started, the end of the melting process and instantaneous values of the consumable electrode melting rate. Complicated remelting conditions, namely, the passage of melting current, often flowing through measuring instruments, electric and magnetic fields, arc discharge interferences, thermal radiation of a molten metal bath, pressure in the furnace chamber, dynamic loads arising in electrode replacement and arc striking, all impede the measurement of the electrode mass and introduce errors commensurate with the measured value.

As for mass transmitters employed in devices for measuring the mass of consumable electrodes, use is made of strain gauges (see, e.g. GFR Pat. No. 1157739, 1964 or US Pat. No. 3179734, Cl. 13–12, 1965) set up in the rope suspension of a rod on which the consumable electrode is fixed. In the above strain gauge arrangement, a main measuring error stems from friction in rod packing, from change in weight of electrical cables and water hoses, as well as from an increase in coolant pressure as the electrode is melted off and the rod descends.

Also known are devices (see, e.g., Alperovich M. E., Beljanchikov L. N., Laktionov V. C. "Programme control of vacuum-arc remelting using consumable electrode" magazine "Metallurgist", No. 4, 1971, pp. 14 – 16), comprising apart from a strain gauge a counter for measuring the electrode mass in terms of its melted-off portion (its length). The counter is associated through a selsyn drive with an electrode holder. However, the above devices fail to provide adequate measuring accuracy due to variation of the density and cross-section of the electrode along its length. Low accuracy of measurement precludes the use of the devices for monitoring the remelting process, especially at its final stage, for estimating the ionization and side discharge effects on the electrode remelting rate.

The readings of the sensitive elements of mass transmitters are also affected by the loop configuration of the cables connected to the rod, which configuration is dependent on the magnitude of the current flowing therethrough.

An American firm "Consarc" has designed a ring-type transmitter (see "Electroslag remelting", a translation from English under the editorship of Corresponding Member of the Academy of Sciences of the Ukrainian Republic Medovar, Kiev, 1973, p. 68) which is mounted directly under the vacuum sealing of the rod. With such arrangement the influence of cable weight on the accuracy of measuring the electrode mass is completely eliminated, though it is partially affected by the weight of the rod proper introduced into the furance chamber and by the pressure of the liquid cooling the rod.

To enhance both the sensitivity and accuracy of measurement of the mass of a consumable electrode, provision can be made for various types of mass transmitters arranged between the rod and the electrode holder. These include Hereus dynamometers (GFR), force transmitters (see, e.g., US Pat. No. 3379818, 1968), magnetostriction transmitters (see, e.g., U.S. Pat. No. 3272905, Cl. 13-9, 1966).

However, the accuracy of measuring the electrode mass by the devices provided with the above transmitters is affected by all the above-specified interferences whereby they do not ensure, in the long run, an adequate measuring accuracy in spite of a high sensitivity of the transmitters themselves.

Also known are devices for measuring the mass of an electrode being remelted in electric furnaces, comprising a hollow cooled rod with a mass transmitter casing secured thereto, the mass transmitter movable element being constituted as a bar with an annular ring rigidly coupled with a consumable electrode holder, the working surface of the annular projection interacting with a sensitive element of said transmitter (see, e.g., US Pat. No. 3272905, Cl. 13–9, 1966).

In the above device, some of the current flowing from the rod to the electrode passes through the magnetostriction-type sensitive element constituted as a winding with a core, the magnetic permeability thereof being a function of the load applied to the core. The magnetic field set up by the current flowing through the sensitive element can also saturate the core, and thus change its magnetic permeability. Different melting currents may cause scatter in the readings of magnetostriction sentitive elements. Moreover, the magnetic permeability of the above cores and the loading force are in a non-linear relationship.

In the device of the type described, only that portion of the rod which is arranged above the magnetostriction elements is exposed to the effect of the coolant. In the above design, the sensitive elements are inevitably heated by the electrode holder. Since it is commonly known that magnetic permeability is temperature-dependent, the measuring error introduced by a change in magnetic permeability becomes inevitable in this case. Errors in measuring with the above device can be the result of the friction of the movable element caused by its deformation under the effect of the electrode mass. Moreover, a small value of the output signal of the mass transmitter hampers the measurements of these signals, differing in microvolts, during long remelting processes lasting many hours and calls for the use of highly sensitive precision instruments.

SUMMARY OF THE INVENTION

The principal object of the present invention is to provide a device for measuring the mass of electrode consumed in electric furnaces ensuring a high accuracy of measurement.

Another object of the invention is to eliminate the effect of dynamic loads on the accuracy of measurement.

These objects are achieved in a device for measuring the mass of electrodes being consumed in electric furnaces, comprising a hollow cooled rod with a mass transmitter casing secured thereto, the mass transmitter having a movable element made constituted as a bar with an annular projection, one of the end faces of said movable element being rigidly coupled with a consumable electrode holder and with the working surface of its annular projection interacting with a transmitter sensitive element, wherein, according to the invention, the sensitive element is constituted as two bellows of different diameter arranged one above the other along the axis of the movable element and secured with their opposing near ends on the annular projection of the movable element and with their remote ends on the casing, the bellow spaces defined by the bellows proper, the casing and by the annular projection communicating with one another and being filled with liquid, variations in the liquid pressure being indicative of the mass of the consumable electrode, the mass transmitter movable element being provided with a recess accommodating the end face of the rod presented to the movable element filled with a current-conducting liquid medium.

It is expedient that an alloy composed of the following ingredients taken in weight per cent: Ga, 62; In, 25; Sn, 13; and featuring a melting point of 10.3° C, be used as the current—conducting liquid medium.

The working surface of the annular projection of the mass transmitter movable element preferably has a conical shape flaring towards the larger-diameter bellows.

It will be favorable if the device is provided with at least one lining of electric insulating material arranged in the mass transmitter so as to eliminate leakage currents through the bellows.

It is also expedient that the lining be disposed between the rod and annular projection of the movable element.

The lining to preferably between the mass transmitter casing and the rod at the point of their attachment.

The recess provided in the rod of the mass transmitter movable element is preferably in communicate with the atmosphere.

It is also good practice that the device be provided with an additional bellows constituted as a sleeve with a connecting rod that is secured to the bottom of the bellows whose space filled with a liquid is in communication with the mass transmitter bellows space, and with a gear mechanism mechanically connected to the connecting rod and adapted to impart motion thereto.

It is efficient for the device to comprise a thermoelement fixed on one of the mass transmitter bellows, and a converter for converting the output signal from the thermoelement (further referred to as "thermosignal") into a control signal, the thermoelement being connected to the converter input whose output should be electrically associated with the rod transfer gear of the additional bellows.

It is of value that at the side of the movable element recess, the casing and the other end face of the mass transsmitter movable element be provided with annular conical projections inclined towards said recess, with the inside diameter of the projection on the casing exceeding that on the end face of the movable element but being smaller than its outside diameter, and with the conical surfaces of the two projections being arranged in immediate proximity to each other when the movable occupies its upper position.

The use in the proposed device for measuring the mass of electrodes being remelted in electric furnaces of bellows as the sensitive elements makes it possible to obtain a powerful linear signal. Due to the use of bellows, the accuracy of measurement of the mass of the consumable electrode is not affected by electromagnetic fields or by the pressure of the rod coolant. The latter is due to the arrangement of the rod end face in the space of the movable element filled with the current-conducting liquid medium. This allows the movable element to be shifted to any extent without breaking the electric melting circuit. Due to the use of the current—conducting liquid medium in the design of the proposed device, the movable element can be transferred without friction and does not require the application of forces that may affect the accuracy of measurement.

BRIEF DESCRIPTION OF THE DRAWING

The nature of the invention will be clear from the following detailed description of a particular embodiment thereof in conjunction with the accompanying drawings, in which.

DETAILED DESCRIPTION

Figure 2:
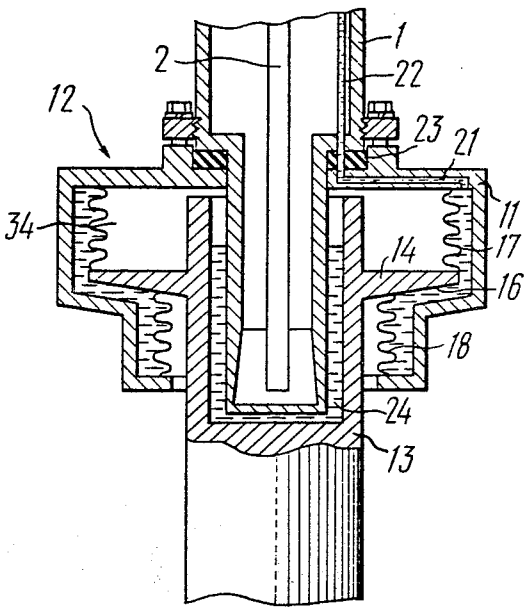
FIG. 2 is a longitudinal sectional view of a mass transmitter of the device of the invention showing the movable element annular projection with the conical working surface.

The herein-proposed device for measuring mass of consumable electrodes being remelted in electric furnaces, comprises a hollow rod 1 (FIG. 1) cooled with water fed via a tube 2, arranged in the rod, the rod 1 being carried vertically by a drive 3. When an electrode 4 is being remelted in an electric furnace, in the described embodiment — in a vacuum-arc furnace 5, the rod 1 is introduced into the chamber of the furnace 5 through a packing ring 6.

The lower part of the furnace 5 accommodates a water-cooled mold 7 adapted for shaping an ingot 8. The mold 7 contains a metal bath with an arc 9 struck between the bath surface and the electrode 4.

To create a vacuum or a protective atmosphere in the furnace 5, the latter is fitted with a branch pipe 10 adapted to couple it with a corresponding unit (not shown in the drawing).

Secured to the rod 1 of the device is a casing 11 of a mass transmitter 12 for the electrode 4. The transmitter 12 comprises a movable element 13 which is a bar having an annular projection 14 at its side surface. Said movable element 13 is rigidly coupled with a holder 15 of the electrode 4, and a working surface 16 of the annular projection 14 interacts with the sensitive element of the mass transmitter 12.

The sensitive element comprises two bellows 17 and 18 of different diameters mounted one above the other in the transmitter casing 11 along the axis of the movable element 13. The oppositely located near ends of the bellows 17 and 18 are secured to the projection 14 of the movable element 13 and their remote ends, to the casing 11. A space 19 defined by the bellows 17 and 18, the casing 11 and the annular projection 14 is filled with a liquid which communicates with a measuring instrument 20 via a conduit 21 provided in the casing 11, and a tube 22 arranged in the rod 1 and sealed by a rubber lining 23 at its connection with the conduit 21. The lining 23 is also employed for sealing the mass transmitter 12.

The measuring instrument 20 is a pressure gauge calibrated in mass units.

Use can be also made of a pressure transmitter producing an electrical signal proportional to the mass of a consumable electrode.

The bar of the movable element 13 has a recess 24 filled with a current-conducting liquid medium, in this particular embodiment, mercury, the recess 24 receiving the lower end face of the rod 1.

In another embodiment of the herein-proposed device an alloy comprising the following components taken in weight per cent: Ga, 62; In, 25; Sn, 13 and featuring a melting point of 10.3° C is employed as the current-conducting liquid medium. Peculiar to the above alloy is a high electric- and heat conductivity, the main advantage of this alloy being that it is not toxic.

A melting current flows through the rod 1, the current-conducting liquid medium, the movable element 13, holder 15 and electrode 4. The heat liberated during the remelting of the consumable electrode 4 is transmitted to the holder 15 which is heated under the effect of thermal radiation of the molten metal bath and the arc 9. Since the heating of the holder 15 adversely affects the measuring accuracy, the excess heat is extracted by the water cooling the rod 1, the cooling rate being increased due to the conical end face of the rod 1 accommodated in the recess 24.

The liquid filling the space 19 of the sensitive element must have minimum compressibility and thermal expansion factors which will ensure a high accuracy of measurement. Gas bubbles remaining in the liquid upon filling the space 19 may introduce measuring errors which increase as the mass of the consumable electrode 4 decreases.

To preclude the accumulation of air bubbles, the working surface 16 (FIG. 2) of the annular projection 14 has a conical shape flaring towards the larger-diameter bellows 17.

In the above-described embodiment, the design of the mass transmitter 12 does not preclude the passage of leakage currents through the bellows 17 and 18 which may lead to the heating of the liquid in the space 19 and to an increase in its volume. This in turn may affect the position of the movable element 13 and introduce a measuring error due to a change in the force required to overcome the stiffness of the bellows 17 and 18.

Figure 3:
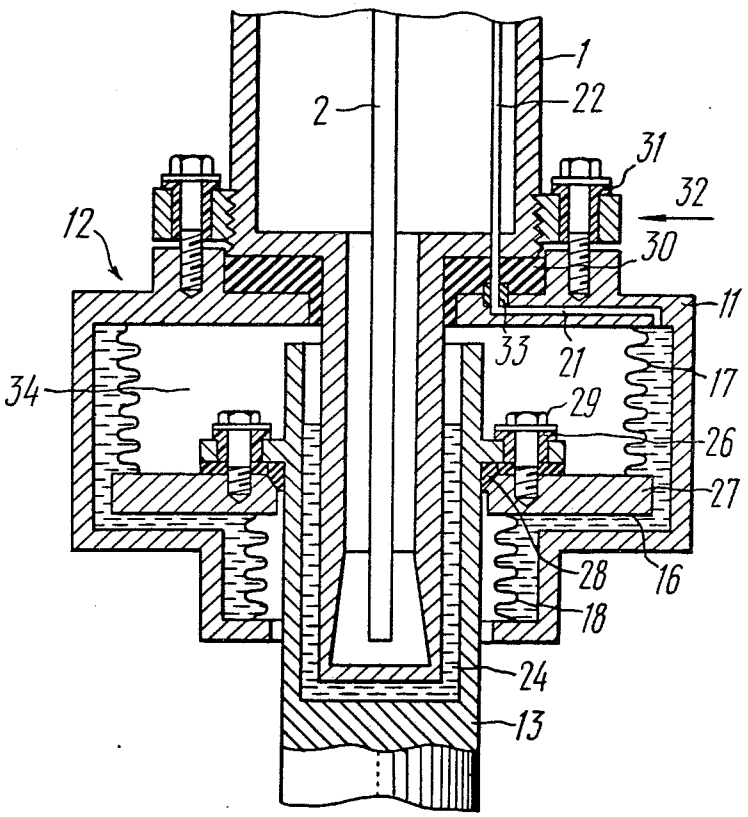
FIG. 3 is similar to FIG. 2 with linings of electric insulating material arranged in the mass transmitter.

The leakage currents flowing through the sensitive element are eliminated by means of an electric-insulating packing 26 (FIG. 3) placed between the bar of the movable element 13 and its annular projection 27, and by using a rubber packing 28. In the above-described embodiment the annular projection 27 is a disc with an opening fastened to the side surface of the bar by bolts 29.

To eliminate the leakage currents between the casing 11 of the mass transmitter 12 and rod 1 at the place of their attachment, a rubber packing 30 is employed. Use is also made of a bush 31 arranged in a bolt joint 32 between the casing 11 and rod 1. To preclude rubber inflow into the conduit 21 provided in the casing 11, the end of the tube 22 connecting the conduit 21 to the measuring instrument 20 (FIG. 1) is isolated from the casing 11 by means of a bush 33 (FIG. 3) manufactured from a hard dielectric substance.

Figure 4:
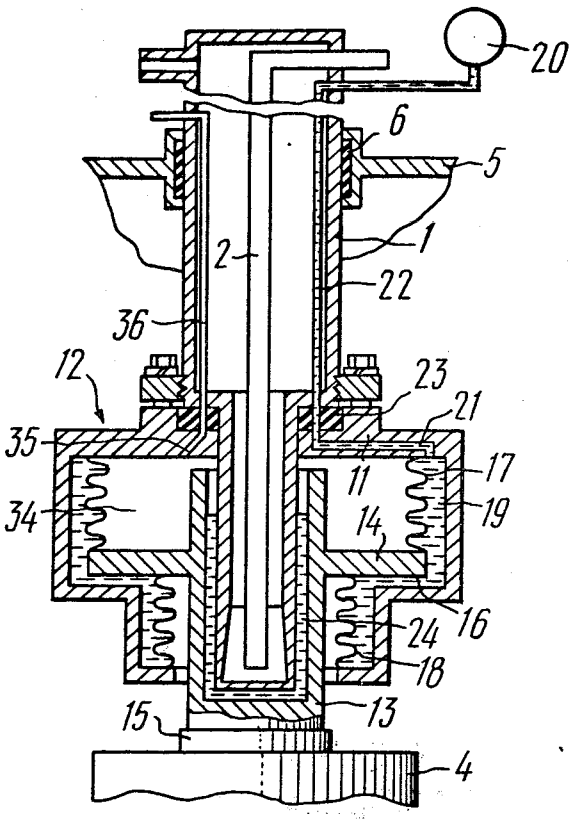
FIG. 4 is a longitudinal sectional view of the device of the invention with a tube through which the mass transmitter space communicates with the atmosphere.

In the course of remelting of the electrode 4, the temperature of the mass transmitter 12 does not remain constant. Under the effect of thermal radiation, the air filling the space 34 (FIG. 4) of the transmitter 12 is heated. Upon heating, the air pressure increases and is transmitted through the annular projection 14 to the bellows 17, 18 of the transmitter 12 introducing thereby an error in measuring the mass of the electrode 4. Moreover, variations in the volume of the space 34 caused by a change in the position of the movable element 13 during the remelting process also introduce a measuring error.

To eliminate the error, the casing 11 of the mass transmitter 12 is fitted with a conduit 35 connecting the space 34 and accordingly the recess 24 in the movable element 13 with the atmosphere via a tube 36 enclosed in the rod 1. The tube 36, as well as the tube 22, is sealed by a rubber seal 23.

The herein-proposed device for measuring the mass of electrodes being remelted in electric furnaces is subjected to dynamic loads arising due to the technological peculiarities of the electrode replacement process and affecting the sensitive element of the mass transmitter 12 and the measuring instrument 20, thus acting on the accuracy of measuring the mass of the electrode 4.

Figure 5:
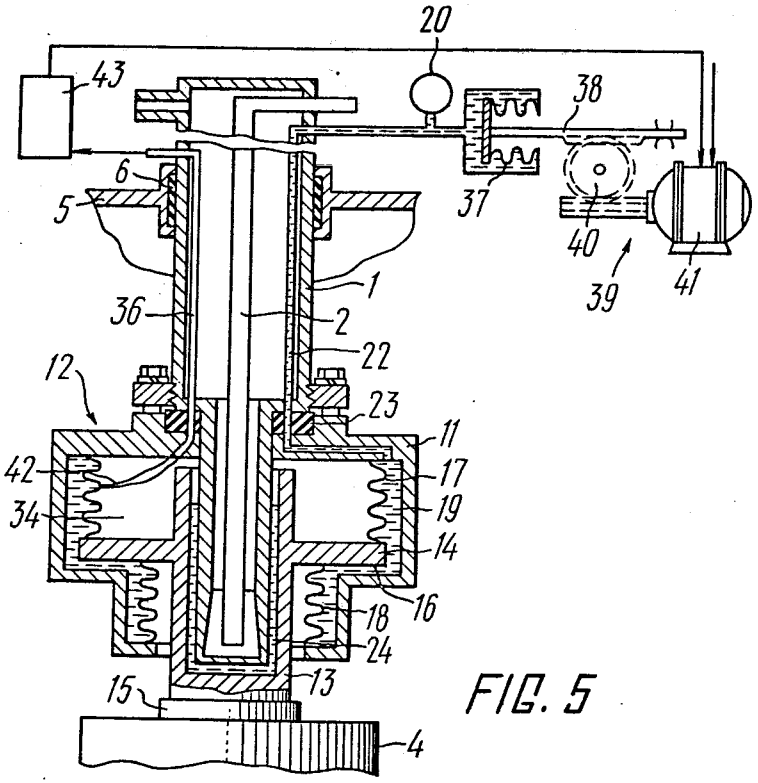
FIG. 5 is a longitudinal sectional view of the proposed device with temperature error compensation.

To eliminate the effect of the dynamic loads the device is equipped with an additional bellows 37 (FIG. 5) constituted as a sleeve with a connecting rod 38 fastened to the sleeve. The space of the bellows 37 is filled with a liquid and communicates with the space 19 of the bellows 17 and 18 of the mass transmitter 12, its connecting rod 38 being mechanically coupled to transfer gear drive 39 comprising a reducer 40 and an electric motor 41.

As previously pointed out, the accuracy of measurement can be affected by temperature fluctuations of the sensitive element. However, in practice these temperature fluctuations of the sensitive element during remelting cannot be avoided completely.

In order to compensate for the temperature fluctuations, the herein-proposed device is provided with a thermoelement 42 fixed on the bellows 17 and having ends extended from the rod 1 through the tube 36 and connected to the input of a converter 43 adapted to convert a thermosignal into a control signal. The converter 43 is made according to a well-known circuit of an automatic bridge with unbalance compensation (see, e.g., K. A. Micronov, L. I. Shepetin "Power engineering and measuring instruments", Mashgiz, Moscow, 1956, pp. 210–216) and its output is electrically associated with the gear drive 39. The gear ratio of the reducer 40 of the gear 39 is so selected that variations in the volume of the space of the additional bellows 37 when its rod 38 is set in motion is equal to those caused by thermal expansion of the liquid in the space 19 of the bellows 17, 18 of the mass transmitter 12.

When an electrode 4 is clamped in the holder 15 and when the arc 9 is struck (FIG. 1) splashes of the current-conducting liquid medium accommodated in the recess 24 of the movable element 13 can get into the space 34 of the mass transmitter 12. To preclude splashing, the casing 11 of the transmitter 12 and the upper end face of the bar of the movable element 13 at the side of said recess 24 are provided with respective conical annular projections 44 (FIG. 6) and 45 inclined towards the recess 24. The inside diameter of the projection 44 exceeds that of the projection 45 but is smaller than its outside diameter, the projection 44 being arranged so that with the movable element 13 occupying its top position the conical surfaces of both projections 44, 45 are disposed in immediate proximity to each other.

The remelting of the consumable electrode 4 (FIG. 1) in electric furnaces, in this particular embodiment in the vacuum arc furnace 5, consists of two stages. The first one involves unloading the furnace 5 and preparing a new electrode 4 for remelting, the second involves the melting process as such.

To avoid the dynamic loads on the measuring instrument 20 and mass transmitter 12 at the first stage of the process when driving out the unmelted portion of the consumable electrode or abruptly lifting a new electrode with the aid of the gear drive 39 (FIG. 5), the bottom of the additional bellows 37 is moved so that the volume of the space filled with the liquid will increase and the liquid contained in the space 19 of the sensitive element of the mass transmitter 12 will be forced into the space of the bellows 37. In this case the annular projection 14 of the movable element 13 of the mass transmitter 12 is placed on the casing 11 of the transmitter 12 and the bellows 17 and 18 are not exposed to dynamic loads arising due to the tension of the rod 1.

Fitting a new electrode 4 in the holder 15 or striking the arc 9 (FIG. 1) by touching the bottom of the mold 7 by the electrode brings about dynamic loads arising due to the compression of the electrode 4. At these loads, the gear drive 39 (FIG. 5) carries the bottom of the additional bellows 37 into another extreme position transferring the liquid into the sensitive element of the mass transmitter 12 until the movable element 13 occupies its extreme upper position.

Upon striking the arc 9 (FIG. 1) a requisite arc gap is established by the drive 3 and the sensitive element of the mass transmitter 12 is set to its working position by shifting the bottom of the additional bellows 37 (FIG. 5) in a direction opposite to that specified and by transferring some liquid from its space into the space 19 of the sensitive element.

The process of preparing the electrode 4 for remelting terminates with this operation and the remelting process is initiated, accompanied by sequential measurement of the mass of the electrode 4.

The pressure of the liquid filling the space 19 of the bellows 17, 18, proportional to the mass of the consumable electrode 4, is fed via the tube 22 to the measuring instrument 20.

Due to the use of the insulating packing 26 (FIG. 3) the melting current flowing through the rod 1, the current-conducting liquid medium filling the recess 24 of the movable element 13, the bar of the movable element 13, the holder 15 of the electrode 4 and the electrode 4, bypasses the sensitive element of the mass transmitter 12.

The absence in the herein-proposed device of dry friction in the movable element 13 of the mass transmitter 12, of electromagnetic interferences acting on the sensitive element, of variations in the pressure of liquid cooling the rod 1 as well as the absence of current in the sensitive element ensures high accuracy in measuring the mass of the consumable electrode 4.

The pressure in the sensitive element of the mass transmitter 12 can be expressed as:

$$P = \frac{G - kx}{S_g} + \gamma H, \text{ where:}$$

Figure 1:
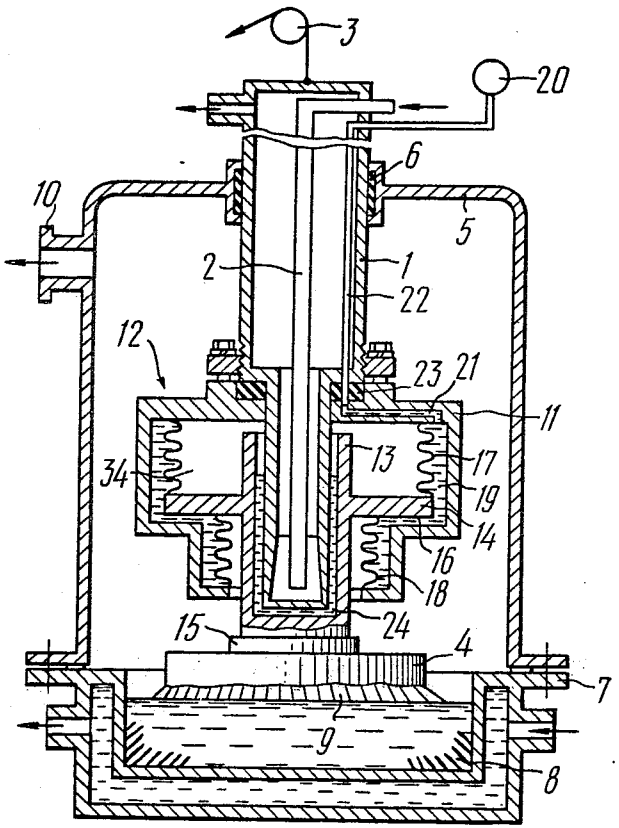
FIG. 1 is a longitudinal sectional view of an electric furnace accommodating the proposed device for measuring the mass of the electrodes being remelted in electric furnaces.

P pressure of liquid in space 19 of mass transmitter 12;

G mass of electrode 4 and movable element 13;

K rigidity factor of all resilient elements in the measuring system;

x stroke of movable element 13;

$S_g$ efficient area of mass transmitter 12;

$\gamma$ density of liquid filling space 19 of mass transmitter 12;

H distance along the vertical from mass transmitter 12 to measuring instrument 20 (FIG. 1).

Value $\gamma$ H does not affect the readings of the measuring instrument 20. Kx << G, since the stroke $x$ is small due to incompressibility of the liquid.

The readings of the mass transmitter 12 are affected by the pressure in the chamber of the furnace 5 but since a $10^{-1}$–$10^{-4}$ mm Hg vacuum is maintained therein, a difference of several dozens of grams produced in measuring the mass can be neglected, the total vacuum pressure being constant.

As the mass of the electrode 4 diminishes in the course of remelting, the annular projection 14 rises changing the volume of the space 34 of the mass transmitter 12. Since the space 34 communicates with the atmosphere via the tube 36 (FIG. 4) accommodated in the rod 1, an excessive or insufficient pressure in said space 34 are always equalized with atmospheric pressure.

The pressure in the space 34 can be stabilized by any known method.

In the course of remelting of similar electrodes or those manufactured from various steel grades and alloys different current conditions may be obtained. A change may occur in the temperature or amount of the rod coolant fed. In this case the coolant filling the space of the mass transmitter sensitive element will absorb thermal radiation from the rod and transmitter movable element, its temperature changing thereby and reducing the accuracy of measurement of the mass of the consumable electrode.

To eliminate the above error caused by the heating of the liquid filling the space of the sensitive element the thermoelement 42 (FIG. 5) fixed on the bellows 17 delivers a signal, proportional to the temperature, to the converter 43 converting the thermosignal into a control signal, the converter being made according to a circuit of an automatic bridge with unbalance compensation.

The unbalance signal is received by a phase responsive amplifier (not shown in the drawing) of the converter 43 and then by its electric motor (not shown in the drawing) decreasing the unbalance signal. At the same time, the signal from the amplifier of said converter 43 is delivered to the electric motor 41 of the gear drive 39 for driving the rod 38 of the additional bellows 37. The gear ratio of the reducer 40 of gear drive 39 is so selected that a change in the volume of the space of the additional bellows 37 during the transfer of its rod 38 is equal to that caused by thermal expansion of the liquid filling the space 19 of the bellows 17 and 18 of the mass transmitter. Such a temperature compensation can provide high accuracy of measurement of the mass of consumable electrodes.

Figure 6:
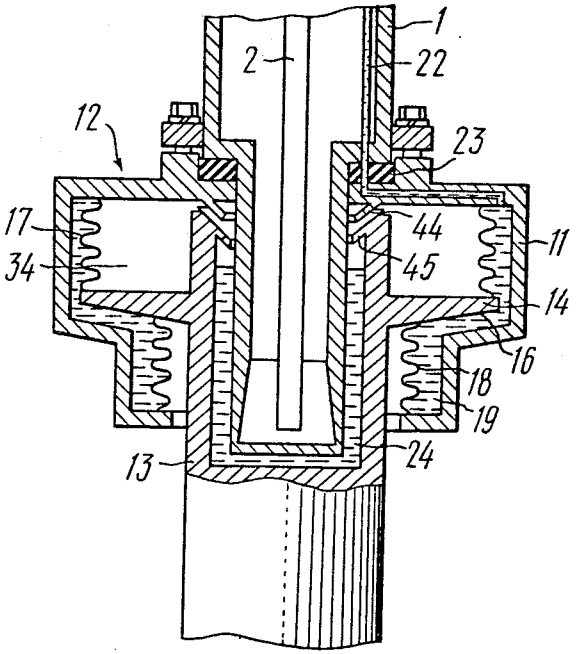
FIG. 6 is similar to FIG. 2 with conical annular projections provided on the casing and on the upper end face of the mass transmitter movable element.

Under the effect of dynamic loads brough about by the replacement of the consumable electrode 4 and acting along the axis of the rod 1, the current-conducting liquid medium filling the recess 24 of the movable element 13 returns to the recess 24 flowing over the conical annular projection 45 (FIG. 6). Some liquid medium that has passed through the narrow gap between the rod 1 and the annular projection 45 reaches the casing 11 of the mass transmitter 12 to flow over the conical surface of the annular projections 44 and 45 into the recess 24.

The proposed device for measuring the mass of electrodes being remelted in electric furnaces may find application in vacuum-arc, electroslag remelting or plasma arc remelting furnaces. In this device the sensitive element of the mass transmitter is not subject to the effect of numerous factors usually characteristic to the electrode remelting process, such as electromagnetic interference, the passage of current through the sensitive elements, variations in rod coolant pressure, friction in the rod packing, variations in the weight and shape of flexible current cables and water hoses. The mass transmitter of the device using a hydraulic sensitive element produces a powerful linear signal at its output.

By virtue of the additional bellows associated with the rod transfer gear drive of this bellows, the movable element of the mass transmitter can be set to extreme positions, a feature completely eliminating the influence of dynamic loads on the transmitter sensitive element and measuring instruments, and with the mass transmitter movable element occupying an intermediate position a continuous measurement of the electrode mass during the entire remelting process is effected. Insofar as it is not possible to avoid temperature fluctuations of the sensitive element, the device is provided with thermal compensation which makes it possible to enhance the accuracy of measurement. This is also achieved by the melting current bypassing the sensitive elements. The herein-proposed device is also simple in design.

What we claim:

1. A device for measuring the mass of electrodes being remelted in electric furnaces, comprising: a hollow cooled rod; a mass transmitter for the consumable electrode secured on said rod; a casing of said mass transmitter; a bar with an annular projection acting as a movable element of said mass transmitter and arranged in said casing; two bellows of different diameter disposed in said casing one above the other along the axis of said bar and functioning as a sensitive element of said mass transmitting; opposing near ends of said bellows being secured on the projection of said bar; remote ends of said bellows being secured on said casing; said annular projection having a working surface by means of which it interacts with said bellows; the spaces of said bellows defined by the bellows proper, by said casing and said annular projection being in communication with one another; a liquid filling said spaces of said bellows, variations in the pressure thereof being indicative of the mass of said consumable electrode; a recess provided on the end face of said bar and accommodating an end face of said rod; a current-conducting liquid medium filling said recess; and a holder of said consumable electrode rigidly associated with the other end face of said bar.

2. The device of claim 1, wherein the current-conducting liquid medium is an alloy comprising the following components taken in weight per cent: Ga, 62; In, 25; Sn, 13, and has a melting point of 10.3° C.

3. The device of claim 1, wherein said working surface of said annular projection of said bar has a conical shape flaring towards the larger-diameter bellows.

4. The device of claim 1, comprising at least one packing of an electric-insulating material arranged in said mass transmitter so as to preclude the passage of leakage currents through said bellows.

5. The device of claim 1, wherein said recess in the end face of said bar communicates with the atmosphere.

6. The device of claim 4 wherein said packing is arranged between said bar and the annular projection.

7. The device of claim 4, wherein said packing is disposed between the casing of said mass transmitter and said rod at the place of their attachment.

8. A device for measuring the mass of electrodes being remelted in electric furnaces, comprising; a hollow cooled rod; a mass transmitter for the consumable electrode secured on said rod; a casing of said mass transmitter; a bar with an annular projection acting as a movable element of said mass transmitter and arranged in said casing; two bellows of different diameter disposed in said casing one above the other along the axis of said bar and functioning as a sensitive element of said mass transmitter; opposing near ends of said bellows being secured on the projection of said bar; remote ends of said bellows being secured on said casing; said annular projection having a working surface by means of which it interacts with said bellows; the spaces of said bellows defined by the bellows proper, by said casing and said annular projection being in communication with one another; a liquid filling said spaces of said bellows, variations in the pressure thereof being indicative of the mass of said consumable electrode; an additional bellows constituted as a sleeve having a space communicating with said spaces of said bellows; a liquid filling said space of said additional bellows; an additional connecting rod fastened to said additional bellows; a gear drive for said additional connecting rod mechanically connected to said rod; a recess provided on the end face of said bar and accommodating an end face of said main rod; a current-conducting liquid medium filling said recess; and a holder of said consumable electrode rigidly coupled with the other end face of said bar.

9. The device of claim 8, comprising: a thermoelement, secured on one of said main bellows; a converter for converting a thermosignal into a control signal, the input of said converter being connected to said thermoelement and the output being electrically associated with said gear drive of said additional connecting rod.

10. A device of claim 8, wherein the current-conducting liquid medium is an alloy which contains the following elements taken in weight per cent: Ga, 62; In, 25; Sn, 13 and has a melting point of 10.3° C.

11. The device of claim 8, comprising at least one packing of an electric-insulating material arranged in said mass transmitter so as to preclude the passage of leakage currents through said main bellows.

12. The device of claim 8, wherein said recess in the end face of said bar communicates with the atmosphere.

13. The device of claim 11 wherein said packing is arranged between said bar and the annular projection.

14. The device of claim 11, wherein said packing is arranged between said casing of said mass transmitter and said main rod at the place of their attachment.

15. A device for measuring the mass of electrodes being remelted in electric furnaces, comprising: a hollow cooled rod; a mass transmitter for the consumable electrode secured on said rod; a casing of said mass transmitter; a bar with an annular projection acting as a movable element of said mass transmitter and arranged in said casing; two bellows of different diameter disposed in said casing one above the other along the axis of said bar and functioning as a sensitive element of said mass transmitter; opposing near ends of said bellows being secured on the projection of said bar; remote ends of said bellows being secured on said casing; said annular projection having a working surface by means of which it interacts with said bellows; the spaces of said bellows defined by the bellows proper, by said casing and said annular projection being in communication with one another; a liquid filling said spaces of said bellows, variations in the pressure thereof being indicative of the mass of said consumable electrode; a recess provided on the end face of said bar and accomodating the end face of said rod; a current-conducting liquid medium filling said recess; conical annular projections respectively provided on said end face of said bar at the side of said recess and said casing and inclined towards said recess, the inside diameter of said projection on said casing exceeding that of said projection on the end face of said bar but being smaller than its outside diameter, the conical surfaces of both projections, with said bar occupying an upper position, being arranged in immediate proximity to each other; and a holder of said consumable electrode rigidly coupled with the other end face of said bar.

16. The device of claim 15, wherein the employed current-conducting liquid medium is an alloy comprising the following components taken in weight per cent: Ga, 62; In, 25; Sn, 13, and has a melting point of 10.3° C.

* * * * *